US009557129B2

(12) United States Patent
Lupher et al.

(10) Patent No.: US 9,557,129 B2
(45) Date of Patent: Jan. 31, 2017

(54) TRIGGER ASSEMBLY AND SYSTEM INCLUDING A BLOCKING MECHANISM

(71) Applicants: John Hancock Lupher, Austin, TX (US); Hillman Lee Bailey, Dripping Springs, TX (US); Michael Eric Reimers, Austin, TX (US)

(72) Inventors: John Hancock Lupher, Austin, TX (US); Hillman Lee Bailey, Dripping Springs, TX (US); Michael Eric Reimers, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 0 days.

(21) Appl. No.: 14/507,626

(22) Filed: Oct. 6, 2014

(65) Prior Publication Data

US 2015/0143731 A1 May 28, 2015

Related U.S. Application Data

(63) Continuation of application No. 13/342,817, filed on Jan. 3, 2012, now Pat. No. 8,850,734.

(51) Int. Cl.

| | |
|---|---|
| ***F41A 17/56*** | (2006.01) |
| ***F41A 19/06*** | (2006.01) |
| ***F41A 17/06*** | (2006.01) |
| ***F41A 19/10*** | (2006.01) |
| ***F41A 19/12*** | (2006.01) |
| ***F41A 19/42*** | (2006.01) |
| ***F41G 1/38*** | (2006.01) |

(52) U.S. Cl.

CPC ..... *F41A 19/06* (2013.01); *F41A 17/06* (2013.01); *F41A 17/56* (2013.01); *F41A 19/10* (2013.01); *F41A 19/12* (2013.01); *F41A 19/42* (2013.01); *F41G 1/38* (2013.01)

(58) Field of Classification Search

CPC ..... F41A 17/56; F41A 17/64; F41A 17/72; F41A 19/06; F41A 17/06; F41A 19/10; F41A 19/12; F41A 19/42; F41G 1/38

See application file for complete search history.

(56) References Cited

U.S. PATENT DOCUMENTS

| | | | | |
|---|---|---|---|---|
| 5,276,554 | A * | 1/1994 | Nassivera | 359/694 |
| 5,525,970 | A * | 6/1996 | Friedman et al. | 340/635 |
| 6,415,542 | B1 * | 7/2002 | Bates | F41A 17/06 42/70.05 |
| 6,735,897 | B1 * | 5/2004 | Schmitter | F41A 17/063 42/70.01 |
| 7,180,425 | B2 * | 2/2007 | Yuasa | G01P 1/127 340/669 |
| 2014/0109458 | A1 * | 4/2014 | Maryfield | F41G 1/473 42/119 |
| 2014/0196341 | A1 * | 7/2014 | Tasyagan | F41A 17/56 42/69.01 |

* cited by examiner

*Primary Examiner* — Stephen M Johnson

(74) *Attorney, Agent, or Firm* — Cesari & Reed LLP; R. Michael Reed

(57) ABSTRACT

A trigger assembly includes a trigger shoe configured to disengage a sear to release a firing mechanism in response to force applied by a user. The trigger assembly further includes a blocking mechanism configured to selectively prevent the release of the firing mechanism in response to a control signal.

19 Claims, 4 Drawing Sheets

TRIGGER ASSEMBLY AND SYSTEM INCLUDING A BLOCKING MECHANISM

CROSS-REFERENCE TO RELATED APPLICATION(S

This application is a continuation of and claims priority to U.S. patent application Ser. No. 13/342,817 filed on Jan. 3, 2012, now U.S. Pat. No. 8,850,734, and entitled "Trigger Assembly and System Including a Blocking Mechanism," which is incorporated herein by reference in its entirety.

FIELD

The present disclosure is generally related to trigger assemblies, and more particularly to trigger assemblies for use with small arms firearms, such as pistols and rifles.

BACKGROUND

Firearm firing mechanisms generally include a number of components that cooperate to hold a spring-loaded hammer or firing pin in a cocked position and then selectively release the hammer or firing pin, which applies force directly, or through an intermediate device, to an ammunition cartridge loaded within a chamber of the firearm. The components for holding a hammer or firing pin in a cocked position and then releasing the hammer or firing pin may be referred to as a trigger assembly.

Generally, the trigger assembly includes a trigger shoe that is accessible to the user to apply a pulling force. When the user pulls the trigger shoe with sufficient force to move the trigger shoe a pre-defined distance, the movement of the trigger shoe releases the spring-loaded hammer or firing pin to fire the ammunition cartridge.

SUMMARY

In an embodiment, a trigger assembly includes a trigger shoe configured to disengage a sear to release a firing mechanism in response to a force applied by a user. The trigger assembly further includes a blocking mechanism configured to selectively prevent the release of the firing mechanism in response to a control signal.

In another embodiment, a trigger assembly includes a trigger shoe that is movable by a user to deliver a first force to a lever to disengage a sear to release a firing mechanism in response to pressure applied by a user. The trigger assembly further includes a blocking mechanism configured to selectively prevent the release of the firing mechanism in response to a control signal.

In still another embodiment, a system includes a trigger assembly and an electronic device. The trigger assembly includes a trigger shoe configured to disengage a sear to release a firing mechanism in response to force applied by a user, and includes a blocking mechanism configured to selectively prevent the release of the firing mechanism in response to a control signal. The electronic device is configured to selectively provide the control signal.

BRIEF DESCRIPTION OF THE DRAWINGS

In the following discussion, the same reference numerals are used in the various illustrated examples to indicate the same or similar elements.

DETAILED DESCRIPTION OF ILLUSTRATIVE EMBODIMENTS

Embodiments of a trigger assembly system are described below that can be utilized with a small-arms firearm to improve accuracy and safety. In an example, the trigger assembly includes a trigger shoe (or trigger) to which a user may apply force to discharge a firearm and a blocking mechanism responsive to a control signal and configured to selectively prevent discharge of the firearm. The blocking mechanism can include an actuator or solenoid that is responsive to the control signal and configured to temporarily prevent discharge of the firearm until some predetermined condition is met.

Unlike a conventional electronic safety mechanism, the blocking mechanism is responsive to a control signal to change between operating modes, for example, from a blocking-enabled mode in which the blocking mechanism operates to prevent disengagement of the firing mechanism, to a conditionally-delayed mode in which the blocking mechanism operates to prevent disengagement of the firing mechanism until a condition is met. Further, the blocking mechanism can be disabled to permit a non-blocking or normal mode in which the trigger assembly disengages the firing mechanism in response to the user-applied force, like a trigger assembly without the blocking mechanism would.

In one instance, the blocking mechanism may be coupled to an electronic device, such as a digital scope, that includes image processing capabilities and that includes a controller configured to generate an electrical signal to selectively block discharge of the firearm until a user-configured digital mark (which can be assigned by the user to a target within a view area of the scope) aligns with the cross-hairs of a reticle of the digital scope or at least aligned to the reticle to a level that is below an error threshold. In another instance, the controller may detect an intervening object between the muzzle of the firearm and the target designated by the user-configured digital mark and may selectively block discharge of the firearm until the line of fire is clear. One possible example of a small-arms firearm that includes an embodiment of a trigger assembly system is described below with respect to FIG. 1.

Figure 1:
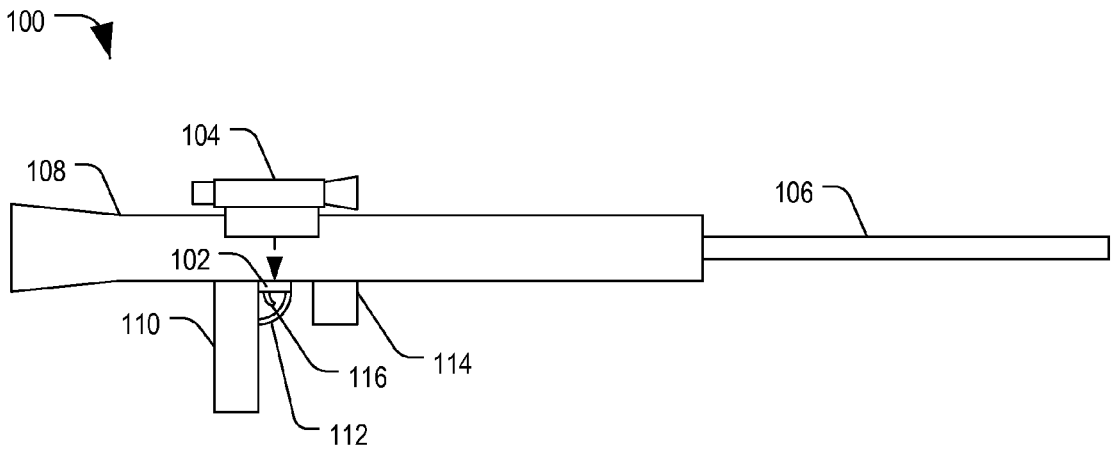
FIG. 1 is a side view of a firearm including a trigger assembly system with a blocking mechanism.

FIG. 1 is a side view of a firearm 100 including a trigger assembly system with a blocking mechanism. In the illustrated example, the firearm 100 is a rifle with a trigger assembly 102 coupled to a digital scope 104. Firearm 100 includes a barrel 106, a stock 108, a handle 110, a trigger guard 112, and a magazine 114.

Digital scope 104 includes circuitry for displaying a view area including the target on a digital display within the scope, for superimposing a digital image of a reticle onto the view area of the digital display, and for allowing a user to apply a digital marker or tag onto the display to identify a target of interest within the view area. Digital scope 104 includes image processing circuitry configured to determine alignment of the digital marker to the reticle and to generate a control signal, which it communicates to trigger assembly 102, when the digital marker is aligned to the reticle to a level of accuracy that is within a pre-determined threshold.

Trigger assembly 102 includes a trigger shoe 116 to which the user can apply force to discharge the firearm 100. Trigger assembly 102 further includes a blocking mechanism (shown for example in FIG. 2) that is responsive to the control signal from digital scope 104 to selectively block discharge of the firearm.

In a first mode, digital scope 104 may be configured to disable the controller. In this instance, the blocking mechanism within trigger assembly 102 is disabled. In this mode, application of force to the trigger shoe 116 can discharge the firearm 100. In a second mode, the controller within digital scope 104 operates to block discharge of the firearm 100 until a certain condition is met. The certain condition may include alignment of a user-defined target (digital marker) to a digital reticle of the scope. In another instance, the certain condition can be a time within a time range, a location within a range of location data, an image processing parameter indicating a clear line of sight to the target indicated by the digital marker, or some other condition.

Figure 2:
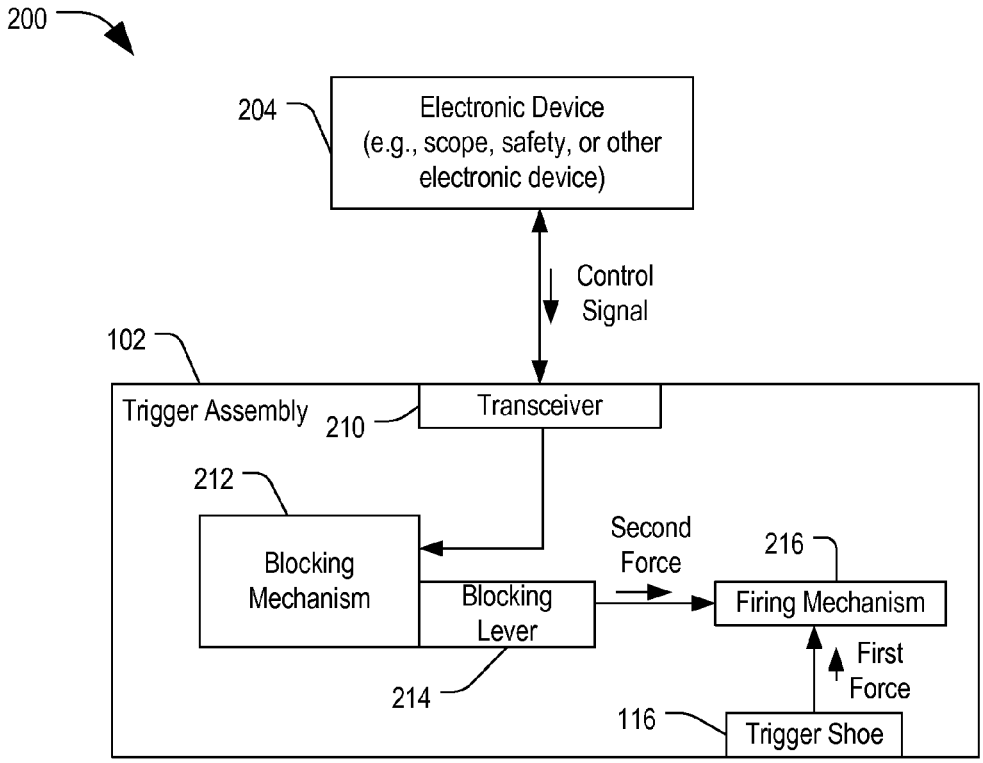
FIG. 2 is a block diagram of an embodiment of the trigger assembly system 200 including trigger assembly of FIG. 1 and an electronic device communicatively coupled to the trigger assembly.

FIG. 2 is a block diagram of an embodiment of the trigger assembly system 200 including trigger assembly 102 of FIG. 1 and an electronic device 204 communicatively coupled to the trigger assembly 102. Electronic device 204 can be a digital scope, an electronic safety device, or another electronic device configured to communicate control signals through a wired or wireless connection to trigger assembly 102.

Trigger assembly 102 includes trigger shoe 116 configured to apply a first force (a trigger force) to a firing mechanism 216 in response to a user-applied force. Trigger assembly 102 further includes a transceiver 210 configured to communicatively couple to electronic device 204. Transceiver 210 can be wired or wireless and configured for bi-directional communication with electronic device 204, such as to receive control signals and to send data. In an example, transceiver 210 may be omitted and the trigger assembly 102 may include a printed circuit board with an interface including pads or contacts for wired interconnection with a controller within electronic device 204. Transceiver 210 (or interface with contacts) includes an output coupled to an input of a blocking mechanism 212, which is configured to control a blocking lever 214 to apply a second force to firing mechanism 216 to prevent disengagement of the firing mechanism, thereby preventing discharge of a firearm, for example. In a particular example, blocking mechanism 212 includes an actuator configured to move blocking lever 214 (which is a movable element) into a blocking position to prevent movement of sear lever 216.

In an example, the blocking mechanism 212 may include a solenoid or other actuator responsive to the control signal from electronic device 204 (a source) to move blocking lever 214 to apply the second force. In an embodiment, the second force is greater than the first force. In a particular example, the first force is proportional to the force applied by the user to the trigger shoe and is limited to a level that is less than the second force so that the user cannot overpower the blocking mechanism 212.

While the above-example has identified one possible implementation involving a small arms firearm, other types of devices that utilize a trigger for activation may also employ a similar blocking mechanism. For example, an electrical paint dispenser trigger may include a blocking mechanism for synchronizing paint spray to a specific location, such that the blocking mechanism prevents discharge of the paint until the dispenser is aimed toward the specific location. In another example, a crossbow may include a trigger to release the bolt and a blocking mechanism 212 to delay or prevent release of the bolt. Other types of trigger-activated devices may also utilize the blocking mechanism to selectively prevent activation.

Figure 3:
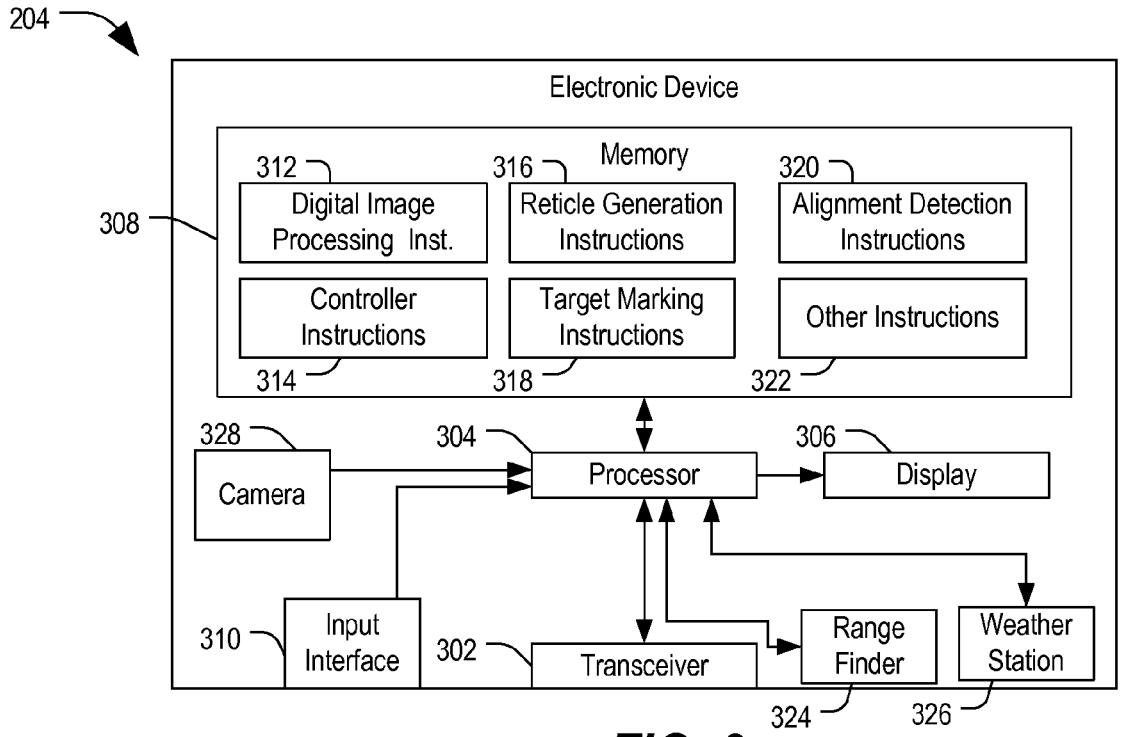
FIG. 3 is a block diagram of an embodiment of the electronic device of FIG. 2.

FIG. 3 is a block diagram of an embodiment of the electronic device 204 of FIG. 2. Electronic device 204 is a data processing device. In one example, electronic device 204 is a digital scope that can be attached to a small arms firearm. In another example, electronic device 204 is a control circuit, a smart phone, a tablet computing device, or some other data processing device. Electronic device 204 includes a transceiver 302 configured to communicate via a wired or wireless communication channel to trigger assembly 102. In an alternative example, transceiver 302 may be replaced with a driver circuit coupled to an interface including pads or contacts that are coupled to trigger assembly 102 through wires. In the alternative example, the driver circuit can drive signals to trigger assembly 102 through the interface.

Electronic device 204 further includes a processor 304 coupled to transceiver 302. Processor 304 is coupled to an input interface 310 to receive user input, a display 306 for displaying text and/or images, to a range finder 324 for determining a distance from the electronic device 204 to a target, and a weather station 326 for determining cross-wind, humidity, and other environmental parameters that can affect the system. In a small arms firearm application, the environmental parameters of interest are any environmental parameters that can impact the trajectory of the bullet.

Electronic device 204 further includes a memory 308 that is coupled to processor 304. Memory 308 stores data and instructions that, when executed by processor 304, cause processor 304 to produce a digital view area with a digital reticle, to receive user inputs for configuring a digital marker on a target within the digital view area, to detect alignment of the digital marker to cross-hairs of the digital reticle, and to control blocking mechanism 212 within trigger assembly 102. Memory 308 stores digital image processing instructions 312 that, when executed, cause processor 304 to operate as an image processing device to process pixel data captured by a camera 328 coupled to processor 304. Memory 308 also stores reticle generation instructions 316 that, when executed, cause processor 304 to produce a digital representation of a reticle (calibrated to the small arms firearm) and to display the digital reticle within the digital view area.

Memory 308 further includes target marking instructions 318 that, when executed, cause processor 304 to receive user input to assign a digital marker onto an object within the digital view area. In a hunting application, the user may interact with input interface 310 (which may include one or more buttons) to apply a digital marker onto a target (such as a deer) that is within the digital view area. Digital image processing instructions 312 can isolate the portion of the digital view area that corresponds to the target having the digital marker so that the digital marker can move with the target as the target moves through the view area captured by camera 328. Memory 308 includes alignment detection instructions 320 that, when executed, causes processor 304 to determine a difference between cross-hairs of the digital reticle from the digital marker.

Memory 308 further includes controller instructions 314 that, when executed, cause processor 304 to control blocking mechanism 212 in FIG. 2. In particular, if the difference determined using alignment detection instructions 320 is less than a threshold difference, controller instructions 314 cause processor 304 to generate a control signal to release the blocking mechanism to allow the small arms firearm to be discharged. If the difference is greater than the threshold, controller instructions 314 cause processor 304 to generate the control signal to prevent discharge. Memory 308 may also include other instructions 322, such as upgrade instructions, user configuration instructions, and so on. Further, memory 308 may store ballistics data, calibration data, user settings, and/or other information.

Figure 4:
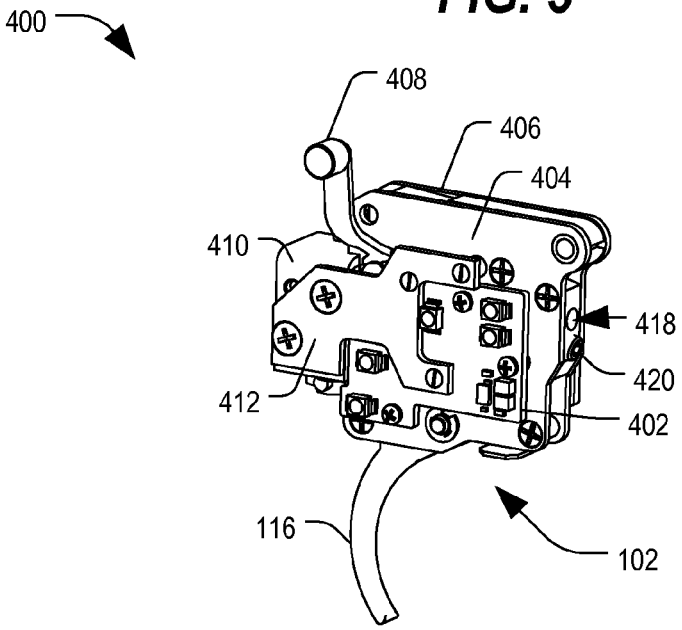
FIG. 4 is a perspective view of an embodiment of a right side of the trigger assembly of FIG. 2.

FIG. 4 is a perspective view 400 of an embodiment of a right side of the trigger assembly 102 of FIG. 2. Trigger assembly 102 includes a printed circuit board 402 that includes circuitry, such as light-emitting diodes (LEDs), sensors, and other circuitry, which can be coupled to an actuator 410, which is part of blocking mechanism 212. In an alternative example, actuator 410 may be replaced with a solenoid or another electrically controllable transducer configured to prevent disengagement of a firing mechanism. Trigger assembly 102 includes side plates 404 and 406 and a safety lever 408 that engages a safety mechanism between side plates to prevent disengagement of the firing mechanism. Trigger assembly 102 further includes an opening 418 for a trigger stop adjustment and a spring force adjustment element 420, which can allow for adjustment of the trigger pull resistance and stop position.

In operation, control signals from electronic device 204 are received by a transceiver on printed circuit board 402 or on a corresponding printed circuit board on the other side of trigger shoe 116. The control signals are provided to actuator 410 to control the blocking lever 214 to prevent discharge of the firearm. When the control signal causes actuator 410 to move the blocking lever 214 into a non-blocking position, force applied to trigger shoe 116 can cause disengagement of the firing mechanism, immediately (i.e., within a predictable amount of time, such as a lock time). In a particular implementation, the lock time can be approximately 5 ms. In an example, blocking mechanism 212 includes actuator 410 and blocking lever 214 and operates as a fire control system and not a safety. An example of the trigger assembly 102 with the side plate 404 removed showing the blocking lever is described below with respect to FIG. 5.

Figure 5:
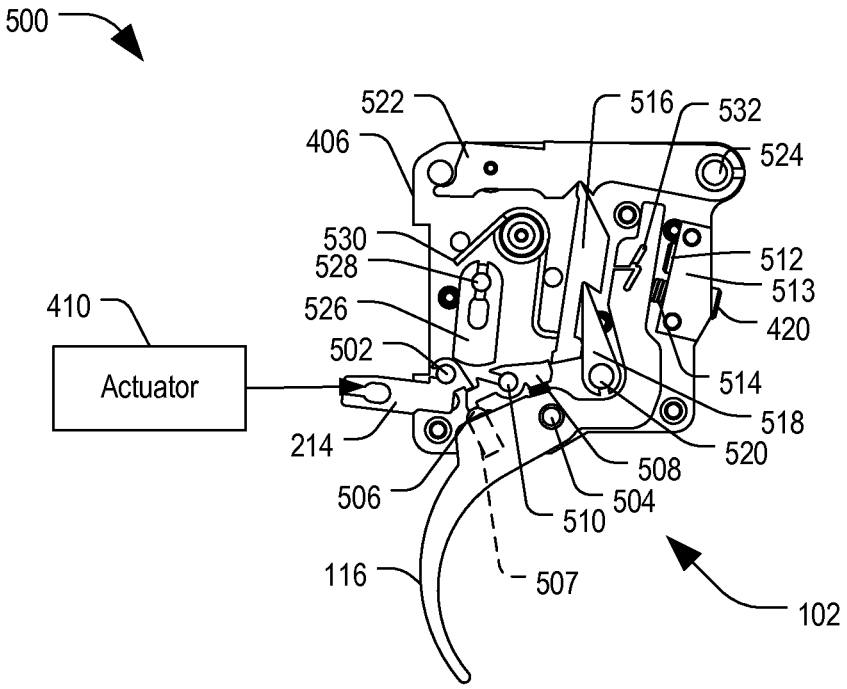
FIG. 5 is a side view of the trigger assembly of FIG. 4.

FIG. 5 is a side view 500 of the trigger assembly 102 of FIG. 4. Trigger assembly 102 includes trigger shoe 116 configured to move about an axis 504 in response to pressure applied by a user, causing a spring plunger 506 recessed in a bore 507 within trigger shoe 116 to contact a sear lever 508 at a contact location. Sear lever 508 contacts a proximal end of a lever 516 at a sear location. A distal end of lever 516 contacts a striker block 522. Lever 518 is configured to pivot about an axis 520 and to contact lever 516 to secure lever 516 against striker block 522. Trigger assembly 102 includes a trigger block 513 including the spring force adjustment element 420 for adjusting a pull force spring 514 and a trigger stop 512.

Trigger assembly 102 further includes striker block 522 configured to pivot about an axis 524 and to engage lever 516. Trigger assembly 102 includes a lever returns spring 530 configured to return lever 516 to a firing position. Trigger assembly 102 also includes a lever 526 configured to pivot about an axis 528 and to couple to safety lever 408. When engaged, lever 526 contacts sear lever 516 to prevent release of striker block 522.

Trigger assembly 102 further includes lever 214 configured to pivot about axis 502 and to contact sear lever 508 when engaged by actuator 410. In an example, actuator 410 is responsive to control signals from electronic device 204 to selectively move lever 214 into or out of contact with sear lever 508 to selectively prevent or allow disengagement of the firing mechanism (e.g., movement of lever 516 to disengage striker block 522).

In operation, trigger shoe 116 is moveable in response to force applied by the user. Spring plunger 506 applies a force proportional to the force applied by the user up to a limit set by the spring force of spring plunger 506. Trigger stop 513 prevents the trigger shoe 116 from advancing far enough to physically contact sear lever 508, allowing spring plunger 506 to supply the force to disengage sear lever 508. By limiting the applied force to the spring force, a solenoid or other electrical component (such as actuator 410) can be configured to move blocking lever 214 into a position with sufficient force to prevent movement of the sear lever 508, even when the user applies significant force to trigger shoe 116. When the control signal is not present, force applied to trigger shoe 116 disengages the firing mechanism.

Figure 6:
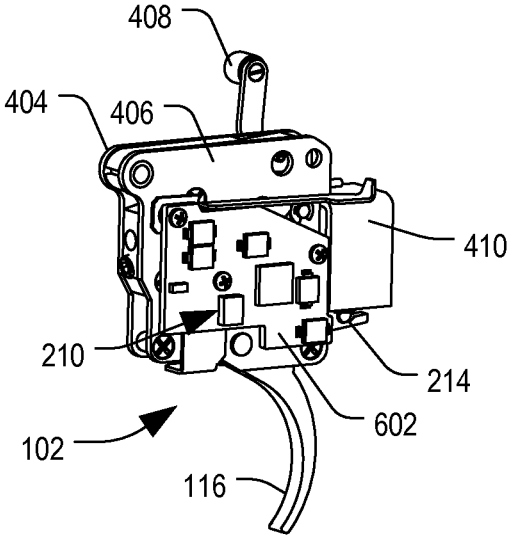
FIG. 6 is a perspective view of a left side of the trigger assembly of FIG. 4.

FIG. 6 is a perspective view 600 of a left side of the trigger assembly 102 of FIG. 4. Trigger assembly 102 includes plates 404 and 406 and a printed circuit board 602 including transceiver 210. Transceiver 210 is coupled to actuator 410, which is configured to selectively move lever 214 to engage sear lever 508 to prevent discharge of the firearm, for example.

In general, the example of the blocking mechanism 212 (including actuator 410 and lever 214) represents one possible implementation of a mechanism to selectively delay or prevent disengagement of a firing mechanism, other configurations are also possible. Examples of other embodiments of the blocking mechanism and lever are described below with respect to FIGS. 7 and 8.

Figure 7:
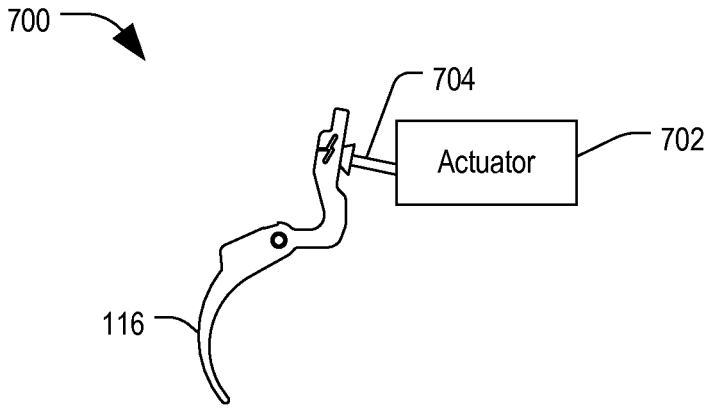
FIG. 7 is a side view of a portion of an embodiment of a trigger assembly including an actuator and a lever configured to block movement of the trigger shoe.

FIG. 7 is a side view of a portion of an embodiment of a trigger assembly 700 including an actuator 702 and a moveable lever 704 configured to block movement of the trigger shoe 116 to prevent disengagement of the firing mechanism. In this instance, actuator 702 is responsive to control signals from electronic device 204 and configured to apply a resistive force to a portion of trigger shoe 116 to prevent the disengagement. In this instance, the moveable lever 704 may include an adjustable trigger stop element that can be adjusted using lever 704 to stop movement of trigger shoe 116.

Figure 8:
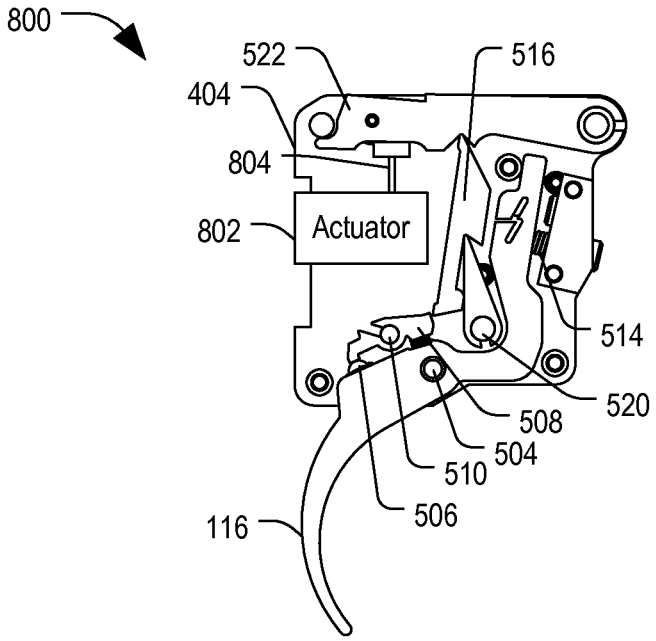
FIG. 8 is a side view of a portion of an embodiment of a trigger assembly including an actuator and a lever configured to block movement of a lever to prevent discharge.

FIG. 8 is a side view of a portion of an embodiment of a trigger assembly 800 including an actuator 802 and a moveable lever 804 configured to block movement of a lever, such as striker block 522, to prevent disengagement of the firing mechanism. In this instance, trigger shoe 116 does not deliver the force applied by the user to striker block 522, allowing actuator 802 to secure striker block 522 against any amount of force applied to trigger shoe 116 by the user.

While the above-examples have described embodiments that utilize an actuator to position a blocking element, such as a blocking lever, to prevent disengagement of the firing mechanism in response to force applied by a user to trigger shoe 116, other blocking mechanisms may also be used. In an example where the trigger assembly is a fully electronic trigger that disengages the firing mechanism using electronic signals, the circuit may replace the actuator and lever with a switch that can be selectively opened to disengage the trigger from the firing mechanism and closed to couple the trigger to the firing mechanism. In this instance, the switch (or some other electronic circuit) can block or allow normal firing in response to a control signal.

In conjunction with the systems and trigger assemblies described above with respect to FIGS. 1-8, a trigger assembly includes a trigger configured to disengage a sear to release a firing mechanism in response to force applied by a user. The trigger assembly further includes a blocking mechanism configured to selectively prevent the release of the firing mechanism in response to a control signal. The control signal may be supplied by an electronic device, such as, a digital scope, a tablet computer, or other data processing device.

Although the present invention has been described with reference to preferred embodiments, workers skilled in the art will recognize that changes may be made in form and detail without departing from the spirit and scope of the invention.

What is claimed is:

1. A firearm comprising:

a gun including a trigger assembly including:

a trigger shoe configured to disengage a sear to release a firing mechanism in response to force applied by a user; and a blocking mechanism configured to selectively prevent the release of the firing mechanism in response to a control signal; and an optical scope including a control circuit coupled to the blocking mechanism and configured to provide the control signal when a selected target is aligned to a reticle of the optical scope.

2. The firearm of claim 1, wherein the blocking mechanism comprises an actuator configured to move a lever into a blocking position to prevent disengagement of the sear in response to the control signal.

3. The firearm of claim 1, wherein the trigger shoe is configured to move in response to the force applied by the user.

4. The firearm of claim 3, wherein the sear comprises:

a first lever configured to engage the firing mechanism; and a second lever configured to engage the first lever at a sear location and receive a trigger force corresponding to movement of the trigger shoe at a second location, the second lever configured to move in response to the movement of the trigger shoe to disengage the first lever.

5. The firearm of claim 4, wherein the trigger shoe comprises:

a bore disposed at a location corresponding to the second location of the second lever; and a spring plunger disposed within the bore and configured to contact the second lever at the second location to deliver a force to the second lever that is proportional to the force applied to the trigger shoe by the user up to a predetermined maximum force.

6. The firearm of claim 1, wherein the blocking mechanism comprises an interface including a transceiver configurable to receive the control signal from an image processing device.

7. An apparatus comprising:

a gun; and a trigger assembly coupled to the gun and including:

a trigger shoe that is movable by a user to deliver a first force to a lever to disengage a sear to release a firing mechanism in response to force applied by a user;

a blocking mechanism configured to selectively prevent the release of the firing mechanism in response to a control signal; and an optical scope coupled to the gun and to the trigger assembly, the optical scope including a control circuit coupled to the blocking mechanism and configured to provide the control signal.

8. The apparatus of claim 7, wherein the sear comprises:

a first lever configured to engage the firing mechanism; and a second lever configured to engage the first lever at a sear location and receive the first force at a contact location, the second lever configured to move to disengage the first lever in response to the first force.

9. The apparatus of claim 8, wherein the trigger shoe comprises:

a bore disposed at a location corresponding to the contact location of the second lever; and a spring plunger disposed within the bore and configured to contact the second lever at the contact location and to deliver the first force to the contact location.

10. The apparatus of claim 9, wherein the first force is proportional to the force applied to the trigger shoe by the user.

11. The apparatus of claim 9, wherein the spring plunger limits the first force.

12. The trigger assembly of claim 8, wherein the blocking mechanism applies a second force to the lever that is greater than the first force to prevent disengagement of the sear.

13. The apparatus of claim 7, wherein the blocking mechanism comprises an actuator responsive to the control signal to selectively prevent the release of the firing mechanism.

14. The apparatus of claim 13, wherein the blocking mechanism further includes a transceiver coupled to the actuator and configured to receive the control signal from the control circuit of the optical scope.

15. An apparatus comprising:

a gun including a trigger assembly having a trigger shoe and a blocking mechanism, the trigger shoe configured to disengage a sear to release a firing mechanism in response to force applied by a user, the blocking mechanism configured to selectively prevent the release of the firing mechanism in response to a control signal; and an optical scope coupled to the trigger assembly of the gun, the optical scope including a control circuit coupled to the blocking mechanism and configured to detect a position of at least one of the trigger shoe and the blocking mechanism, the control circuit configured to selectively provide the control signal to the blocking mechanism to enable discharge when a selected target is aligned to a reticle of the optical scope.

16. The apparatus of claim 15, wherein the optical scope comprises a digital scope configured to generate the control signal and to transmit the control signal to the blocking mechanism of the trigger assembly.

17. The apparatus of claim 15, wherein the blocking mechanism comprises:

a moveable element; and an actuator coupled to the movable element and responsive to the control signal to position the movable element to prevent the release of the firing mechanism.

18. The apparatus of claim 15, wherein the sear comprises:

a first lever configured to engage the firing mechanism; and a second lever configured to engage the first lever at a sear location and receive a trigger force corresponding to movement of the trigger shoe at a second location, the second lever configured to move in response to the movement of the trigger shoe to disengage the first lever.

19. The apparatus of claim 18, wherein the trigger comprises:

a bore disposed at a location corresponding to the second location of the second lever; and a spring plunger disposed within the bore and configured to contact the second lever at the second location to deliver a force to the second lever that is proportional to the pressure applied to the trigger shoe by the user up to a predetermined limit.

* * * * *